US009347392B2

(12) United States Patent
Lee et al.

(10) Patent No.: US 9,347,392 B2
(45) Date of Patent: May 24, 2016

(54) CONTROL SYSTEM AND CONTROL METHOD OF GASOLINE DIRECT INJECTION ENGINE

(71) Applicant: Hyundai Motor Company, Seoul (KR)

(72) Inventors: Heungseok Lee, Seoul (KR); Wan Soo Oh, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 613 days.

(21) Appl. No.: 13/712,666

(22) Filed: Dec. 12, 2012

(65) Prior Publication Data

US 2014/0121943 A1 May 1, 2014

(30) Foreign Application Priority Data

Oct. 31, 2012 (KR) ..... 10-2012-0122128

(51) Int. Cl.

| | |
|---|---|
| ***F02D 41/30*** | (2006.01) |
| ***F02D 41/04*** | (2006.01) |
| ***F02D 41/38*** | (2006.01) |
| *F02M 59/36* | (2006.01) |

(52) U.S. Cl.

CPC ..... *F02D 41/042* (2013.01); *F02D 41/3082* (2013.01); *F02D 41/3854* (2013.01); *F02D 2200/0602* (2013.01); *F02M 59/367* (2013.01)

(58) Field of Classification Search

CPC ... F02D 41/042; F02D 41/06; F02D 41/3836; F02D 41/3845; F02D 41/3854; F02D 2250/31; F02M 59/367

USPC ..... 701/102–105, 112; 123/495, 500–503

See application file for complete search history.

(56) References Cited

U.S. PATENT DOCUMENTS

| | | | | |
|---|---|---|---|---|
| 6,668,805 | B2 * | 12/2003 | Kato et al. | 123/491 |
| 7,431,018 | B2 * | 10/2008 | Tsujimoto | 123/446 |
| 7,552,720 | B2 * | 6/2009 | Borg et al. | 123/508 |
| 7,856,960 | B2 * | 12/2010 | Serra et al. | 123/446 |
| 2001/0006061 | A1 * | 7/2001 | Shimada et al. | 123/495 |
| 2001/0023683 | A1 * | 9/2001 | Nakamura et al. | 123/457 |
| 2003/0121502 | A1 * | 7/2003 | Kato et al. | 123/447 |
| 2005/0005912 | A1 * | 1/2005 | Joos et al. | 123/458 |
| 2005/0061297 | A1 * | 3/2005 | Oono | 123/458 |
| 2005/0199219 | A1 * | 9/2005 | Utsumi | 123/458 |
| 2006/0048752 | A1 * | 3/2006 | Stroia et al. | 123/458 |
| 2007/0028897 | A1 * | 2/2007 | Fukasawa | 123/467 |
| 2007/0051340 | A1 * | 3/2007 | Tsujimoto | 123/378 |
| 2007/0221173 | A1 * | 9/2007 | Hazama | 123/458 |
| 2008/0059039 | A1 * | 3/2008 | Nakagawa et al. | 701/99 |
| 2009/0118991 | A1 * | 5/2009 | Ueda | 701/112 |
| 2009/0240417 | A1 * | 9/2009 | Fushiki et al. | 701/103 |
| 2010/0012096 | A1 * | 1/2010 | Kieferle et al. | 123/497 |

(Continued)

FOREIGN PATENT DOCUMENTS

| | | | |
|---|---|---|---|
| DE | 102008042371 | A1 * | 4/2009 |
| EP | 0886058 | A2 * | 12/1998 |

(Continued)

*Primary Examiner* — Mahmoud Gimie
*Assistant Examiner* — John Zaleskas
(74) *Attorney, Agent, or Firm* — Morgan, Lewis & Bockius LLP

(57) ABSTRACT

A control system and a control method of a gasoline direct injection engine may include determining whether the engine is stopped and can improve NVH of a vehicle by keeping the fuel high-pressure pump input valve of the high-pressure pump operating for a predetermined time and preventing fuel from flowing backward to the low-pressure pump.

5 Claims, 2 Drawing Sheets

(56) References Cited

U.S. PATENT DOCUMENTS

| | | | | |
|---|---|---|---|---|
| 2010/0101536 | A1* | 4/2010 | Nakata | 123/457 |
| 2011/0129363 | A1* | 6/2011 | Sakai et al. | 417/289 |
| 2012/0037122 | A1* | 2/2012 | Veit et al. | 123/457 |
| 2014/0100759 | A1* | 4/2014 | Lee et al. | 701/103 |

FOREIGN PATENT DOCUMENTS

| | | | | |
|---|---|---|---|---|
| JP | 07103097 | A | * | 4/1995 |
| JP | 2007046482 | A | * | 2/2007 |
| JP | 2009079564 | A | * | 4/2009 |
| JP | 2011185164 | A | * | 9/2011 |

* cited by examiner

CONTROL SYSTEM AND CONTROL METHOD OF GASOLINE DIRECT INJECTION ENGINE

CROSS-REFERENCE TO RELATED APPLICATION

The present application claims priority to Korean Patent Application No. 10-2012-0122128 filed on Oct. 31, 2012, the entire contents of which is incorporated herein for all purposes by this reference.

BACKGROUND OF THE INVENTION

1. Field of the Invention

The present invention relates to a control system and a control method of a GDI (Gasoline Direct Injection) engine.

2. Description of Related Art

In general, the fuel system of a GDI engine is equipped with a low-pressure pump that is operated by a motor to supply fuel onto a fuel rail in a fuel tank and with a high-pressure pump, which is operated by the camshaft, on a head cover.

Further, injectors that inject fuel into combustion chambers, respectively, are mounted and a pressure sensor that detects the internal pressure of the fuel rail is mounted on the fuel rail.

The fuel supplied to the engine from the fuel tank by the low-pressure pump is pressurized to a predetermined pressure, about up to 120 bar, by the high-pressure pump that is operated by a fuel pump cam, and then supplied to the fuel rail.

The pressure sensor mounted on the fuel rail detects the pressure in the fuel rail and provides the information about the pressure to a control unit, and the control unit feedback-controls the fuel pressure to maintain optimum pressure for the conditions of driving.

The high-pressure pump used in the fuel system of the GDI engine may generally includes a plunger, a control valve, and a solenoid valve.

The high-pressure pump pressurizes the fuel while the plunger vertically reciprocates with the operation of the fuel pump cam. The pressure that compresses the fuel is controlled in accordance with when the control valve, which is an inlet valve, closes between the top dead center and the bottom dead center of the plunger. When the pressure that compresses the fuel reaches a predetermined pressure or more, an outlet valve that mechanically operates opens and high-pressure fuel moves to the injectors.

Therefore, the fuel can be discharged only when the control valve that is an inlet valve is closed, such that the control unit controls the discharge amount and the pressure of the fuel by controlling the closing time of the control valve, using a solenoid.

When ignition of the engine is stopped (IGNITION OFF) by stopping the engine, the high-pressure pump stops (OFF) within 0.1 second. When the high-pressure pump stops, the control valve is fully open, such that the fuel pressurized in the high-pressure pump flows backward into the high-pressure pump.

Therefore, vibration and noise are generated by pressure pulsation of the fuel flowing backward into the low-pressure pump, such that NVH (Noise Vibration Harshness) is deteriorated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a control system and a control method having advantages of a GDI (Gasoline Direct Injection) engine which can improve NVH of a vehicle by operating a high-pressure pump under predetermined conditions, even if the GDI engine stops.

In an aspect of the present invention, a control method of a gasoline direct injection engine that may include a low-pressure pump connected to a high-pressure pump, may include determining whether a key for starting the engine is turned off, determining a stroke of the high-pressure pump when the key for starting the engine is turned off, opening a high-pressure pump input valve that selectively blocks a fluid flow between the low-pressure pump and the high-pressure pump, when a determined stroke of the high-pressure pump is an expansion stroke and a difference in the internal pressures of the high-pressure pump and the low-pressure pump is a predetermined pressure or less, and determining whether an RPM of the engine is a predetermined RPM or less to finish control process of the control method.

The method may further include determining a time point of closing the high-pressure pump input valve and closing the high-pressure pump input valve by comparing the internal pressure of the high-pressure pump with a predetermined critical pressure, when the determined stroke of the high-pressure pump is a compression stroke.

The time point of closing the high-pressure pump input valve is maintained at a current time point of closing the high-pressure pump input valve, when the internal pressure of the high-pressure pump is the predetermined critical pressure or less, and delayed by a predetermined time from the current time point of closing the high-pressure pump input valve when the internal pressure of the high-pressure pump is not the predetermined critical pressure or less.

The determining of the stroke of the high-pressure pump is performed by measuring the internal pressure of the high-pressure pump.

The predetermined RPM is 0.

In another aspect of the present invention, a control system of a gasoline direct injection engine, may include a low-pressure pump disposed at a fuel tank, a high-pressure pump fluid-connected to the low-pressure pump and including a pressure chamber having an inlet and an outlet, a plunger reciprocated in the pressure chamber by a fuel pump cam, a high-pressure pump input valve disposed to selectively close the inlet of the pressure chamber and stop fuel flowing inside the high-pressure pump from the low-pressure pump, a high-pressure pump output valve disposed to selectively open the outlet of the pressure chamber and supply the fuel in the pressure chamber to injectors from the high-pressure pump in accordance with a reciprocation of the plunger, an actuator connected to and operating the high-pressure pump input valve to selectively open the inlet of the pressure chamber, a high-pressure pump pressure sensor measuring an internal pressure of the high-pressure pump, a low-pressure pump pressure sensor measuring an internal pressure of the low-pressure pump, an ignition key sensor, a crankshaft rotation sensor, and a control unit receiving signals from the high-pressure pump pressure sensor, the low-pressure pump pressure sensor, the ignition key sensor, and the crankshaft rotation sensor, and controlling the injectors and the actuator, wherein the control unit is configured to determine whether a key for starting the engine is turned off, determine a stroke of the high-pressure pump when the engine is turned off, control the actuator to operate the high-pressure pump inlet valve so as to open the inlet of the pressure chamber when a determined stroke of the high-pressure pump is an expansion stroke and a difference in internal pressures of the high-pressure pump and the low-pressure pump is a predetermined pressure or less, and determine whether an RPM of the engine is a predetermined RPM or less to finish control process of the control unit.

The actuator is a solenoid.

A first elastic member is mounted on the high pressure inlet valve to elastically bias the high pressure inlet valve toward the inlet of the pressure chamber.

A second elastic member is mounted on the high pressure outlet valve to elastically bias the high pressure outlet valve toward the outlet of the pressure chamber.

When the determined stroke of the high-pressure pump is a compression stroke, the control unit determines time point of closing the high-pressure pump input valve by comparing the internal pressure of the high-pressure pump with a predetermined critical pressure, and closes the high-pressure pump input valve by controlling the actuator.

The control unit controls the actuator by maintaining a current time point of closing the high-pressure pump input valve, when the internal pressure of the high-pressure pump is the predetermined critical pressure or less, and delays the current time point of closing the high-pressure pump inlet valve by a predetermined time and controls the actuator, when the internal pressure of the high-pressure pump is not the predetermined critical pressure or less.

The control unit determines the stroke of the high-pressure pump by measuring the internal pressure of the high-pressure pump.

The predetermined RPM is 0.

According to a control system and a control method of a gasoline direct injection engine of an exemplary embodiment of the present invention, since the fuel high-pressure pump input valve of the high-pressure pump keeps operating, even if the engine stops, NVH (Noise Vibration Harshness) of a vehicle is improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
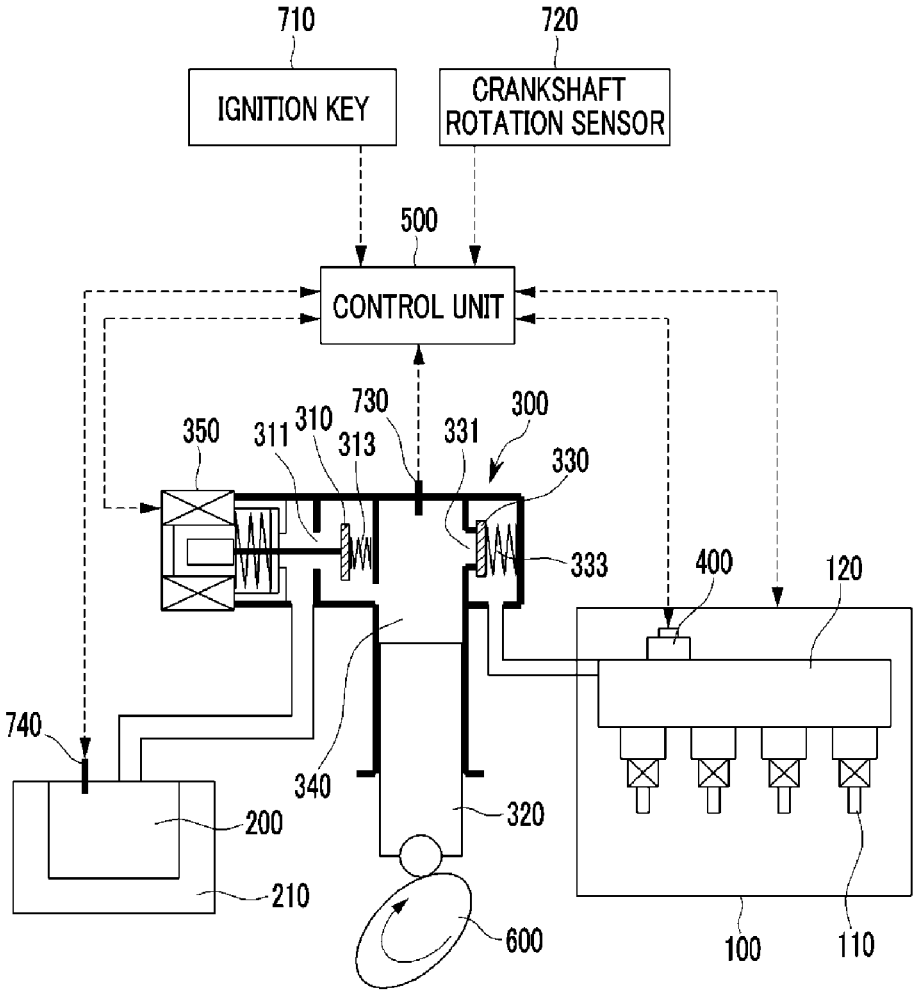
FIG. 1 is a block diagram illustrating a control system of a GDI engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described in detail with reference to the accompanying drawing.

FIG. 1 is a block diagram illustrating a control system of a GDI engine according to an exemplary embodiment of the present invention.

Referring to FIG. 1, a control system of a GDI (Gasoline Direct Injection) engine according to one or a plurality of exemplary embodiments includes: a high-pressure pump 300 including a plunger 320 reciprocated by a fuel pump cam 600, a low-pressure pump 200 disposed in a fuel tank 210, a high-pressure pump input valve 310 selectively stopping fuel flowing inside from the low-pressure pump 200, a high-pressure pump output valve 330 disposed in the high-pressure pump 300 to selectively supply the fuel to injectors 110 from the high-pressure pump 300, a solenoid 350 operating the high-pressure pump input valve 310, a high-pressure pump pressure sensor 730 measuring the internal pressure of the high-pressure pump 300, a low-pressure pump pressure sensor 740 measuring the internal pressure of the low-pressure pump 200, an ignition key sensor 710, a crankshaft rotation sensor 720, and a control unit 500 receiving signals from the high-pressure pump pressure sensor 730, the low-pressure pump pressure sensor 740, the ignition key sensor 710, and the crankshaft rotation sensor 720 and controlling the injector 110 and the solenoid 350.

A GDI engine 100 is a gasoline engine that allows fuel to be directly injected into combustion chambers, in which fuel supplied from the low-pressure pump 200 disposed in the fuel tank 210 is pressurized by the high-pressure pump 300 and supplied to a fuel rail 120, and then the fuel is directly injected into (combustion chambers of) the engine 100 from the injectors 110 that communicate with the fuel rail 120.

A pressure sensor 400 is disposed on the fuel rail 12, measures the internal pressure of the fuel rail 120, and transmits a corresponding signal to the control unit 500.

An inlet 311 that connects the low-pressure pump 200 with the pressure chamber 340 of the high-pressure pump 300 and an outlet 331 that connects the pressure chamber 340 with the fuel rail 120 are formed in the high-pressure pump 300.

In the high-pressure pump 300, a first elastic member 313 is disposed and elastically supports the high-pressure pump pressure valve 310 and a second elastic member 333 is disposed and elastically supports the high-pressure pump output valve 330.

The solenoid 350 opens the inlet 311 by selectively pushing the high-pressure pump inlet valve 310 in response to a control signal from the control unit 500. Accordingly, the low-pressure pump 200 and the pressure chamber 340 of the high-pressure pump 300 are connected.

The high-pressure pump output valve 330 closed by the elastic force of the second elastic member 333 opens the outlet 331, when the internal pressure of the pressure chamber 320 increases, such that the pressure chamber 320 and the fuel rail 120 are connected.

The control unit 500 determines whether the key for starting the engine 100 is turned off and determines the stroke of the high-pressure pump 300, and controls the solenoid 350 to open the high-pressure pump inlet valve 310 and determines whether the RPM of the engine is predetermined RPM or less, when the determined stroke of the high-pressure pump 300 is an expansion stroke and the difference in internal pressure of the high-pressure pump 300 and the low-pressure pump 200 is a predetermined pressure or less.

Further, when the determined stroke of the high-pressure pump 300 is a compression stroke, the control unit 500 determines the time point of closing the high-pressure pump input valve 310 by comparing the internal pressure of the high-pressure pump 300 with a predetermined critical pressure, and performs it by controlling the solenoid 350.

Figure 2:
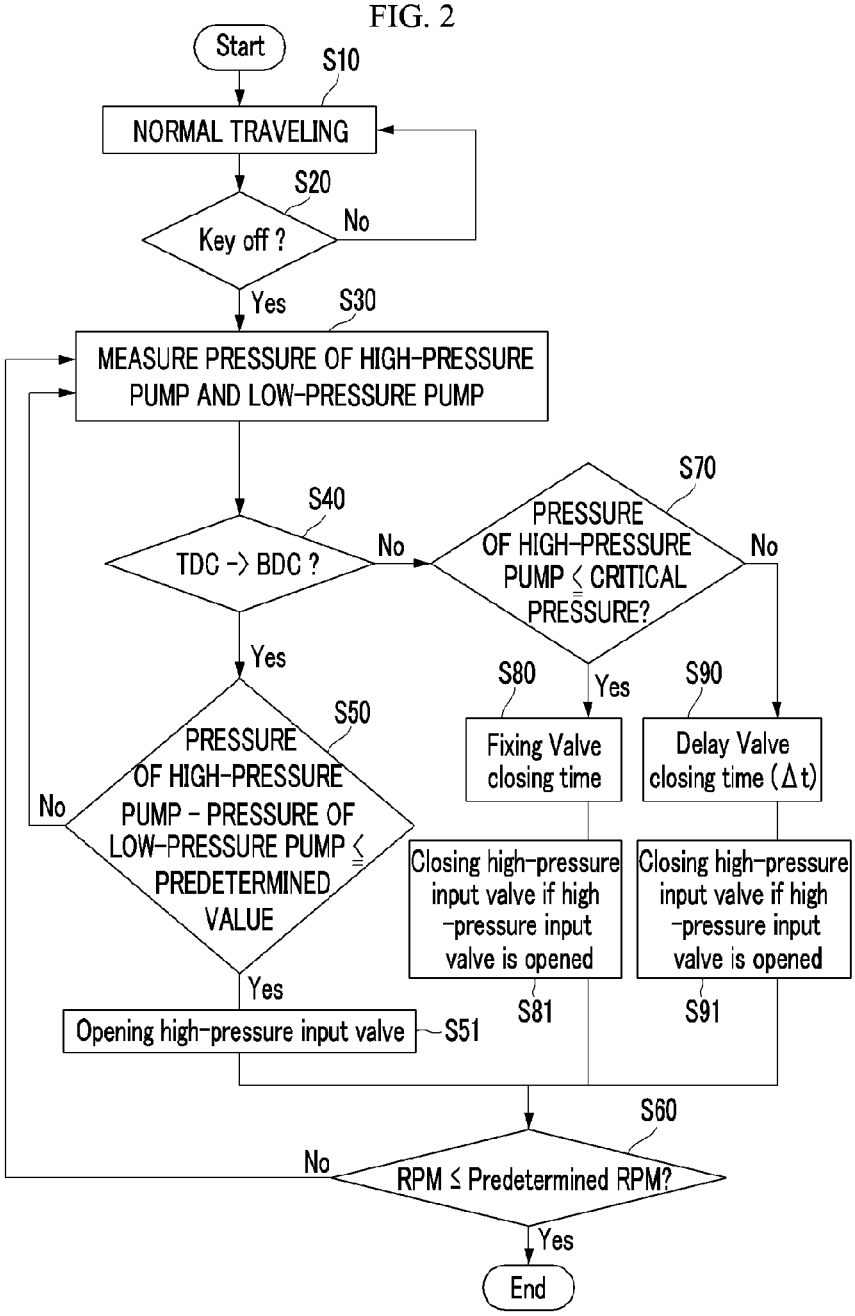
FIG. 2 is a flowchart illustrating a control method of a GDI engine according to an exemplary embodiment of the present invention.

FIG. 2 is a flowchart illustrating a control method of a GDI engine according to an exemplary embodiment of the present invention.

A control method of a GDI engine according to an exemplary embodiment of the present invention is described hereafter with reference to FIGS. 1 and 2.

In a control method of a GDI engine according to an exemplary embodiment of the present invention, in normal traveling of a vehicle (S10), the control unit 500 determines whether the key for starting the engine 100 is turned off on the basis of a signal inputted from the ignition key sensor 710 (S20), and receives corresponding signals from the high-pressure pump pressure sensor 730 measuring the internal pressure of the high-pressure pump 300 and from the low-pressure pump pressure sensor 740 measuring the internal pressure of the low-pressure pump 200, when the key for starting the engine 100 has been turned off (S30).

The control unit 500 determines the stroke of the high-pressure pump 300 on the basis of the signals inputted from the high-pressure pump pressure sensor 730 and the low-pressure pump pressure sensor 740 (S40). For example, when the signal from the high-pressure pump pressure sensor 730 is increasing, it is determined that the high-pressure pump 300 is in the compression stroke, or when the signal from the high-pressure pump pressure sensor 730 is decreasing, it is determined that the high-pressure pump 300 is in the expansion stroke.

When the determined stroke of the high-pressure pump 300 is the expansion stroke, that is, when the plunger 320 is moving from the TDC (Top Dead Center) to the BDC (Bottom Dead Center), and when the difference in internal pressure of the high-pressure pump 300 and the low-pressure pump 200 is a predetermined pressure or less, the control unit 500 opens the high-pressure pump input valve 310 that selectively blocks the low-pressure pump 200 and the high-pressure pump 300 (S50). That is, the internal pressure of the high-pressure pump 300 is larger than that of the low-pressure pump 200, and as the high-pressure pump input valve 310 opens upon opening the engine, the fuel in the high-pressure pump 300 rapidly flows into the low-pressure pump 220, such that pulsation noise may be generated.

However, since the high-pressure pump input valve 310 opens only when the difference in internal pressure of the high-pressure pump 300 and the low-pressure pump 200 is a predetermined pressure or less (S51), in the control method of a GDI engine according to an exemplary embodiment of the present invention, it is relatively possible to prevent the possibility of pulsation noise. The predetermined pressure is a pressure that can prevent the possibility of pulsation noise and can be determined from an experiment.

Currently, it is possible to prevent pulsation noise by allowing the high-pressure pump input valve to open only when the internal pressure of the high-pressure pump 300, that is, of the pressure chamber 320 is the predetermined pressure or less while the plunger 320 moves from the TDC to the BDC.

The control unit 500 applies a control current to the solenoid 350, and when the control current is applied to the solenoid valve 350, the solenoid valve 350 pushes the high-pressure pump input valve 310 and connects the high-pressure pump 300 with the low-pressure pump 200.

Thereafter, the control unit 500 ascertains RPM of the engine 100 from a signal from the crankshaft rotation sensor 720 and determines whether the RPM of the engine is predetermined RPM or less (S60). The predetermined RPM is the standard of determining whether to apply the control method of a GDI engine according to an exemplary embodiment of the present invention to the current operation status of the engine 100, and the control of the control method of a GDI engine according to an exemplary embodiment of the present invention may be finished, when the engine 100 completely stops. That is, the predetermined RPM may be "0".

When the determined stroke of the high-pressure pump 300 is the compression stroke, that is, when it is determined that the plunger 320 is moving from the BDC to the TDC, the control unit determines the time point of closing the high-pressure pump input valve 310 and closes it (S80, S81, S90 and S91), by comparing internal pressure of the high-pressure pump 300 and the predetermined critical pressure (S70).

The time point of closing the high-pressure pump input valve 310 is maintained at the current time point of closing the high-pressure pump input valve 300, when the internal pressure of the high-pressure pump 300 is the predetermined critical pressure or less (S80), and it is delayed by a predetermined time $\Delta t$ from the current time point of closing the high-pressure pump input valve (S90) and the valve is closed (S91). That is, as the high-pressure pump input valve 310 is closed, the internal pressure of the high-pressure pump 300, that is, the pressure chamber 320 increases and the engine 100 is not in operation at present, such that the high-pressure pump 300 may be broke, when the high-pressure pump input valve 310 is closed in the compression stroke of the high-pressure pump 300.

The predetermined time $\Delta t$ is a time for making the internal pressure of the high-pressure pump 300 at the predetermined critical pressure or less and can be determined from an experiment.

Thereafter, the control unit 500 checks the RPM of the engine 100 from the signal from the crankshaft rotation sensor 720 and determines whether the RPM of the engine is the predetermined RPM or less (S60), and when it is not the predetermined RPM or less, the control unit 500 returns to S30.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A control system of a gasoline direct injection engine, comprising:

a low-pressure pump disposed at a fuel tank;

a high-pressure pump fluid-connected to the low-pressure pump and including:

a pressure chamber having an inlet and an outlet;

a plunger reciprocated in the pressure chamber by a fuel pump cam;

a high-pressure pump input valve disposed to selectively close the inlet of the pressure chamber and stop fuel flowing inside the high-pressure pump from the low-pressure pump; and a high-pressure pump output valve disposed to selectively open the outlet of the pressure chamber and supply the fuel in the pressure chamber to injectors from the high-pressure pump in accordance with a reciprocation of the plunger;

an actuator connected to and operating the high-pressure pump input valve to selectively open the inlet of the pressure chamber;

a high-pressure pump pressure sensor measuring an internal pressure of the high-pressure pump;

a low-pressure pump pressure sensor measuring an internal pressure of the low-pressure pump;

an ignition key sensor;

a crankshaft rotation sensor; and a control unit receiving signals from the high-pressure pump pressure sensor, the low-pressure pump pressure sensor, the ignition key sensor, and the crankshaft rotation sensor, and controlling the injectors and the actuator, wherein the control unit is configured to:

determine whether a key for starting the engine is turned off, determine a stroke of the high-pressure pump when the key for starting the engine is turned off, control the actuator to operate the high-pressure pump inlet valve that selectively blocks a fluid flow between the low-pressure pump and the high-pressure pump so as to open the inlet of the pressure chamber when the determined stroke of the high-pressure pump is an expansion stroke and a difference in internal pressures of the high-pressure pump and the low-pressure pump is a predetermined pressure or less, determine whether an RPM of the engine is less than or equal to a predetermined RPM to finish control process of the control unit, determine a time point of closing the high-pressure pump input valve when the determined stroke of the high-pressure pump is a compression stroke, wherein the time point of closing the high-pressure pump input valve is maintained at a current time point of closing the high-pressure pump input valve, when the internal pressure of the high-pressure pump is a predetermined critical pressure or less, and wherein the time point of closing the high-pressure pump input valve is delayed by a predetermined time from the current time point of closing the high-pressure pump input valve when the internal pressure of the high-pressure pump is not the predetermined critical pressure or less, and close the high-pressure pump input valve, if the high-pressure pump input valve is opened, wherein the determining of the stroke of the high-pressure pump is performed by measuring the internal pressure of the high-pressure pump.

2. The system of claim 1, wherein the actuator is a solenoid.

3. The system of claim 1, wherein a first elastic member is mounted on the high-pressure pump inlet valve to elastically bias the high-pressure pump inlet valve toward the inlet of the pressure chamber.

4. The system of claim 1, wherein a second elastic member is mounted on the high-pressure pump outlet valve to elastically bias the high-pressure pump outlet valve toward the outlet of the pressure chamber.

5. The system of claim 1, wherein when the RPM of the engine is equal to the predetermined RPM, the RPM of the engine is 0.

* * * * *